US008318002B2

(12) United States Patent
Baillargeon

(10) Patent No.: US 8,318,002 B2
(45) Date of Patent: Nov. 27, 2012

(54) LUBRICANT COMPOSITION WITH IMPROVED SOLVENCY

(75) Inventor: David J. Baillargeon, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1521 days.

(21) Appl. No.: 11/637,346

(22) Filed: Dec. 12, 2006

(65) Prior Publication Data

US 2007/0138053 A1 Jun. 21, 2007

Related U.S. Application Data

(60) Provisional application No. 60/750,563, filed on Dec. 15, 2005.

(51) Int. Cl.
*C10M 101/02* (2006.01)

(52) U.S. Cl. ..... 208/19; 208/950; 508/110

(58) Field of Classification Search ..... 208/18, 208/33, 19, 950; 508/110
See application file for complete search history.

(56) References Cited

U.S. PATENT DOCUMENTS

| | | | | |
|---|---|---|---|---|
| 4,406,771 | A * | 9/1983 | Briens et al. | 208/33 |
| 5,460,713 | A | 10/1995 | Takito et al. | |
| 6,080,301 | A | 6/2000 | Berlowitz et al. | |
| 6,475,960 | B1 | 11/2002 | Berlowitz et al. | |
| 6,627,779 | B2 | 9/2003 | O'Rear | |
| 6,703,353 | B1 | 3/2004 | Lok et al. | |
| 2002/0193646 | A1 | 12/2002 | O'Rear | |
| 2004/0094453 | A1 | 5/2004 | Lok et al. | |
| 2004/0178118 | A1 * | 9/2004 | Rosenbaum et al. | 208/18 |
| 2005/0098476 | A1 | 5/2005 | Miller | |

FOREIGN PATENT DOCUMENTS

| | | | |
|---|---|---|---|
| WO | WO 03/027210 | A1 | 4/2003 |
| WO | WO 2004/053030 | A2 | 6/2004 |
| WO | WO 2004/113473 | | 12/2004 |

* cited by examiner

*Primary Examiner* — Ellen McAvoy
*Assistant Examiner* — Chantel Graham

(57) ABSTRACT

Lubricating base oils/base stocks comprising one or more hydrodewaxate and/or hydroisomerate base stock(s) and/or base oil(s), GTL base stock(s) and/or base oil(s) or mixture thereof, preferably GTL base stock(s) and/or base oil(s) of improved solvency comprise said base stock combined with a Group I base stock/base oil selected from the group consisting of high viscosity Group I mineral oil, preferably Bright Stock.

The solvency and the capability to solubilize performance additives of base oils comprising one or more hydrodewaxate and/or hydroisomerate base stock(s) and/or base oil(s), GTL base stock(s) and/or base oil(s) or mixture thereof, preferably GTL base stock(s) and/or base oil(s) is improved by the addition to said base oils of a Group I base oil/base stock selected from the group consisting of high viscosity Group I mineral oil, preferably Bright Stock.

38 Claims, 1 Drawing Sheet

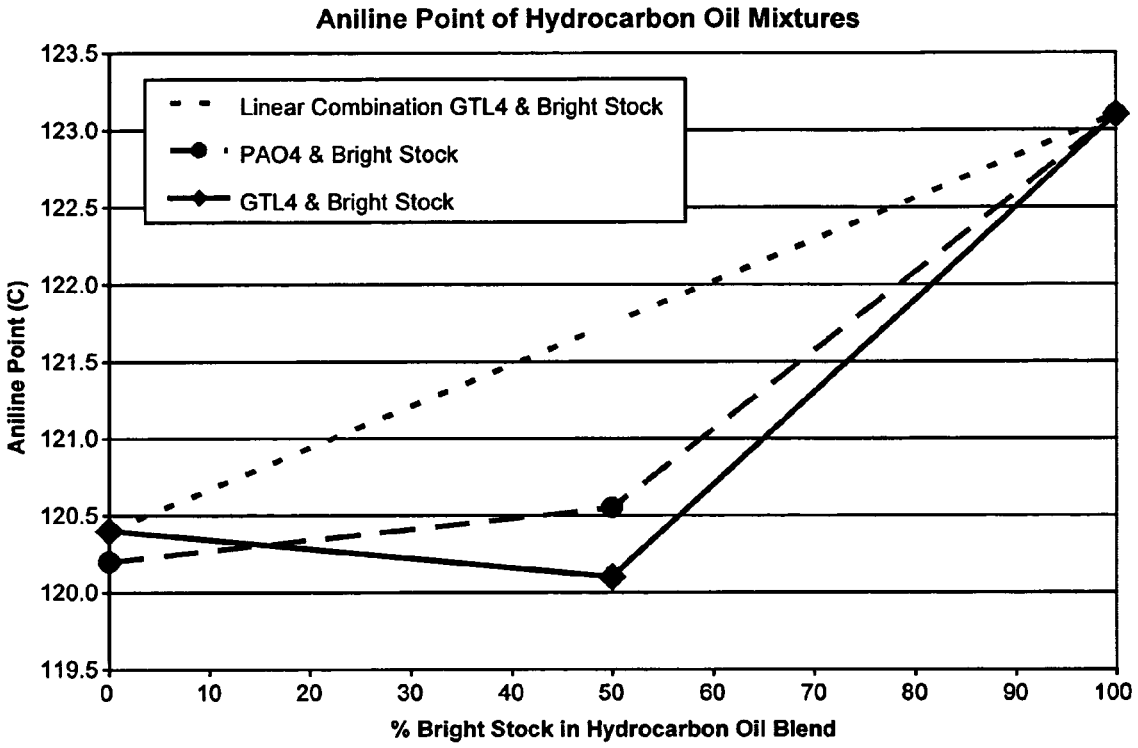
Aniline Point of Hydrocarbon Oil Mixtures
Linear Combination GTL4 & Bright Stock
PAO4 & Bright Stock
GTL4 & Bright Stock
Aniline Point (C)
123.5
123.0
122.5
122.0
121.5
121.0
120.5
120.0
119.5
0
10
20
30
40
50
60
70
80
90
100
% Bright Stock in Hydrocarbon Oil Blend

LUBRICANT COMPOSITION WITH IMPROVED SOLVENCY

This application claims the benefit of U.S. Ser. No. 60/750,563 filed Dec. 15, 2005.

BACKGROUND OF THE INVENTION

1. Field of the Invention

The present invention is directed to lubricant base oils/base stocks used to produce formulated lubricants containing performance additives.

2. Description of the Related Art

Hydrocarbon base oils have differing solvency characteristics that affect their capability to solubilize performance additives. Highly paraffinic hydro-carbon base oils (those having low levels of aromaticity) are known to have low-to-poor additive solubility characteristics. For example, such low-solvency hydrocarbon base oils include polyalpha olefins (PAO) which are 100% isoparaffinic and have essentially 0% aromatics content. Similarly, wax isomerate base oils/base stocks, in particular hydroisomerized Fischer-Tropsch (F-T) lubricant fluids, often called Gas-to-Liquids (GTL) lubricant base oils/base stocks, are very highly paraffinic and have essentially 0% aromatics content. Consequently, such wax isomerate base oils would be expected to have low solvency and poor additive solubility performance, and this has in fact been found to be the case.

To address this concern one would expect that the mere addition of an aromatics containing stream to such low solvency base oils/base stocks would uniformly cure the solvency deficiency of such base oils and that such improvement in solvency would be, at best, a linear relationship base on the inherent solvency (expressed as aniline point) of each constituent.

Solvency of lube base oils/base stocks is classically measured by aniline point, and differences in aniline point indicate differences in the solvency capabilities of lube base oils/base stocks and consequently reflect on their capabilities in solubilizing performance additives. Solubility performance increases as aniline point decreases.

Currently, highly paraffinic base oils, such as PAO, are typically used with a co-base oil (e.g., hydrocarbyl oils containing amide, ester, carboxyl, carbonyl, ether, aromatic, or other chemical functionality capable of solvating additives) to provide adequate additives solubility in finished lubricants or functional fluids.

Analogous to PAO, highly paraffinic GTL-type wax-derived base oils would likely be used in combination with hydrocarbyl co-base oils, for example aromatics-containing co-base oils, which may include mineral oils (Group I type). In particular, GTL-type wax-derived base oil/Group I mineral oil combinations could have substantial economic advantages, with the potential for lower cost base oil mixtures which would be useful in formulated lubricant compositions or functional fluids.

The advantage to using a mineral oil as the co-base oil is readily apparent in terms of availability, cost, quality control, quantity, etc.

US 2004/0094453 addresses a process for producing a lube base oil blend which comprises (a) recovering a F-T derived distillate fraction characterized by a kinematic viscosity of about 2 $mm^2/s$ or greater but less than 3 $mm^2/s$ at 100° C. and (b) blending the aforesaid F-T derived distillate fraction with a petroleum derived base oil selected from the group consisting of a Group I base oil, a Group II base oil, a Group III base oil or a mixture of two or three of any of the aforesaid conventional base oils to produce a blend lubricant base oil having a viscosity of about 3 $mm^2/s$ or greater. In the text formulated lubricants comprising F-T derived base oils mixed with 600 neutral and heavy neutral oils are presented. F-T derived base oils having a KV of about 2.5 $mm^2/s$ at 100° C. were also combined with bright stock to produce a blended base oil but such a blend was not additized to yield a formulated oil. Only the viscosities, VI, pour point, CCS@−25° C., TGA Noack of such blends are reported.

WO 2004/053030 is directed to functional fluids having low Brookfield viscosity using high viscosity index base oils/base stocks. One such high viscosity index base oil/base stock is identified as Invention Oil B which is described as being made from a F-T wax feedstock. This F-T wax base oil is combined with a comparative base stock in a 50/50 basis and additized. As is clear from Table 4 of WO 2004/053030 the comparative base stock is not bright stock insofar as a formulated lubricant made by adding only 11.379 vol % additive to the comparative base stock produced a blend having a viscosity of only 7.614 $mm^2/s$@100° C., far below what would be expected had the competitive base stock been a bright stock.

U.S. Pat. No. 6,627,779 is directed to blended lube base oils comprising about 99 wt % to about 50 wt % highly paraffinic lube base stock and about 1 wt % to about 50 wt % alkyl aromatics, alkyl cycloparaffins or mixtures thereof. Highly paraffinic base stocks such as F-T derived lube base stocks typically have poor additive solubility. To address this deficiency such base stocks are usually mixed with various co-solvents such as synthetic esters. Synthetic esters are expensive, however, so the resulting blends are also expensive. To overcome this problem U.S. Pat. No. 6,627,779 teaches the addition of from about 1 wt % to about 50 wt % alkyl aromatic, alkyl cycloparaffinis or mixtures thereof to highly paraffinic F-T lube base oils to improve, among other characteristics, the solvency properties of the base oil.

DESCRIPTION OF THE FIGURE

FIG. 1 is a graphical representation of aniline point for mixtures of PAO/Bright Stock and wax isomerate/Bright Stock over different Bright Stock concentrations.

DESCRIPTION OF THE INVENTION

It has been discovered that the solvency capabilities of base oils comprising one or more hydrodewaxate and/or hydroisomerate base stock(s) and/or base oil(s), GTL/base stock(s) and/or base oil(s), mixtures thereof, preferably GTL base stock(s) and/or base oil(s), is non-linearly improved when such stock(s), is/are combined with a Group I base stock selected from the group consisting of high viscosity mineral oil stock, preferably bright stock.

The improvement in the solvency capabilities of the base oil comprising one or more hydrodewaxate and/or hydroisomerate base stock(s) and/or base oil(s), GTL base stock(s) and/or base oil(s) and mixtures thereof, preferably GTL base stock(s) and/or base oil(s), plus high viscosity mineral oil stock(s), preferably Bright Stock combination is greater than that demonstrated by PAO base oil/base stock in combination with the same high viscosity mineral oil stock, preferably Bright Stock at the same combination ratios.

In a first embodiment the present invention is directed a lubricant base oil comprising one or more hydrodewaxate and/or hydroisomerate base stock(s) and/or base oil(s), GTL base stock(s) and/or base oil(s), and mixtures thereof, preferably GTL base stock(s) and/or base oil(s) combined with Group I base oil/base stock selected from the group consisting of high viscosity mineral oil base oil/base stock, preferably Bright Stock.

In another embodiment the present invention is directed to a method for improving the solvency capabilities of base oil comprising one or more hydrodewaxate and/or hydroisomerate base stock(s) and/or base oil(s), GTL base stock(s) and/or base oil(s), and mixture thereof, preferably GTL base stock(s) and/or base oil(s), by the addition thereto of a Group I base oil/base stock selected from the group consisting of high viscosity mineral oil stock, preferably Bright Stock.

In yet another embodiment the present invention is directed to lubricating oil formulations comprising a base oil comprising one or more hydrodewaxate and/or hydroisomerate base stock(s) and/or base oil(s), GTL base stock(s) and/or base oil(s), and mixtures thereof, preferably GTL base stock(s) and/or base oil(s), combined with Group I base oil/base stock(s) selected from the group consisting of high viscosity mineral oil stock(s), preferably Bright Stock and containing a minor amount of at least one performance improving additive.

In still another embodiment the present invention is directed to a method for making a lubricating oil formulation by adding at least one performance improving additive to a lube oil base oil comprising one or more hydrodewaxate and/or hydroisomerate base stock(s) and/or base oil(s), GTL base stock(s) and/or base oil(s), and mixtures thereof, preferably GTL base stock(s) and/or base oil(s) combined with a Group I base oil/base stock(s) selected from the group consisting of high viscosity mineral oil stock, preferably Bright Stock.

In another embodiment the present invention is directed to an additive concentrate comprising at least one performance improving additive in a dissolving quantity of a lube base oil comprising one or more hydrodewaxate and/or hydroisomerate base stock(s) and/or base oil(s), GTL base stock(s) and/or base oil(s), and mixtures thereof, preferably GTL base stock(s) and/or base oil(s) combined with a Group I base oil/base stock(s) selected from the group consisting of high viscosity mineral oil stock, preferably Bright Stock.

In still another embodiment the present invention is directed to the lubrication of machines, equipment, etc., requiring lubrication by use of a lubricant comprising one or more hydrodewaxate and/or hydroisomerate base stock(s) and/or base oil(s), GTL base stock(s) and/or base oil(s), and mixtures thereof, preferably GTL base stock(s) and/or base oil(s) combined with a Group I base oil/base stock(s) selected from the group consisting of high viscosity mineral oil stock, preferably Bright Stocks and/or by the use of such a lubricant further containing at least one performance additive.

It is surprising that the solvency of the hydrodewaxate and/or hydroisomerate base stock(s) and/or base oil(s), GTL base stock(s) and/or base oil(s), and mixtures thereof, preferably GTL base oil/base stock(s) and/or base oil(s), and especially the solvency of GTL wax hydrodewaxate and/or hydroisomerate base stock(s) and/or base oil(s), can be improved, as indicated by the improvement in (i.e., lowering of) the aniline point, by the addition thereto of Group I high viscosity mineral oil stock(s), preferably Bright Stock, when one considers that the aniline point of the Bright Stock is itself so much higher than that of the aforesaid base oil to which it is added. It is unexpected that the aniline point of, e.g., such an oil mixture will be lower than the aniline points of either of the oil components making up the mixture or that Group I high viscosity mineral oil stock(s), preferably Bright Stock could be used to lower the aniline point/increase the solvency properties of the aforesaid base oils/base stock(s).

Aniline point (according to ASTM D611) is a very sensitive measure of the solvency of a lubricant fluid. Aniline points are reported as temperatures measured to 0.1° C. Aniline point differences as small as 0.4-0.5° C. are considered significant, and can have tangible effects on the miscibility of lubricant additives, for example on maximum additive concentration, and on the clarity of a lubricant composition containing one or more additives.

Hydrodewaxate and/or hydroisomerate base stock(s) and/or base oil(s), GTL base stock(s) and/or base oil(s), and mixtures thereof, preferably GTL base stock(s) and/or base oil(s) of this invention are fluids of lubricating viscosity that derive from the transformation of high pour point hydrocarbyl feedstock materials, such feedstock materials containing nil to measurable amounts of sulfur, nitrogen, and/or oxygen. The high pour point hydrocarbyl feedstock materials that are suitable feed materials for transformation (via one or more process steps) into the base stocks and base oils employed herein are predominantly hydrocarbonaceous materials, composed of predominantly linear hydro-carbon molecular segments, with suitable feed materials having pour points greater than about 30° C., preferably greater than about 50° C., more preferably greater than about 60° C., even more preferably greater than about 70° C., and in certain instances, even more preferably greater than about 80° C., as measured by ASTM method D97.

One embodiment is directed to wax hydrodewaxate and/or hydro-isomerate base oils/base stocks that derive from high pour point feedstock materials that are predominantly paraffinic hydrocarbons, comprised of normal paraffins, branched paraffins, cycloparaffins, or mixtures thereof.

A preferred embodiment is directed to GTL base oils/base stock(s) that derive from high pour point materials that are predominantly synthetic paraffinic hydrocarbons derived from a Fischer-Tropsch hydrocarbon synthesis type process.

A more preferred embodiment is directed to GTL wax hydrodewaxate and/or hydroisomerate base oils/base stock(s) that derive from high pour point feedstock materials that are predominantly synthetic paraffinic hydrocarbons, derived from synthesis processes based on molecular combination and/or rearrangement chemistries.

An even more preferred embodiment is directed to GTL base stock(s) and/or base oil(s) that derive from high pour point materials that are predominantly synthetic paraffinic hydrocarbons derived from a Fischer-Tropsch hydrocarbon synthesis type process that further comprises the use of cobalt in the synthesis catalyst.

The base stocks/base oils employed in the present invention include one or more of a mixture of base stock(s) and/or base oil(s) derived from one or more Gas-to-Liquids (GTL) materials, as well as hydrodewaxed, or hydroisomerized/conventional cat (or solvent) dewaxed base stock(s) and/or base oil(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

As used herein, the following terms have the indicated meanings:

a) "wax"—hydrocarbonaceous material having a high pour point, typically existing as a solid at room temperature, i.e., at a temperature in the range from about 15° C. to 25° C., and consisting predominantly of paraffinic materials;

b) "paraffinic" material: any saturated hydrocarbons, such as alkanes. Paraffinic materials may include linear alkanes, branched alkanes (iso-paraffins), cycloalkanes (cycloparaffins; mono-ring and/or multi-ring), and branched cycloalkanes;

c) "hydroprocessing": a refining process in which a feedstock is heated with hydrogen at high temperature and under pressure, commonly in the presence of a catalyst, to remove and/or convert less desirable components and to produce an improved product;

d) "hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;

e) "catalytic dewaxing": a conventional catalytic process in which normal paraffins (wax) and/or waxy hydrocarbons, e.g., slightly branched iso-paraffins, are converted by cracking/fragmentation into lower molecular weight species to insure that the final oil product (base stock or base oil) has the desired product pour point;

f) "hydroisomerization" (or isomerization): a catalytic process in which normal paraffins (wax) and/or slightly branched iso-paraffins are converted by rearrangement/isomerization into branched or more branched iso-paraffins (the isomerate from such a process possibly requiring a subsequent additional wax removal step to ensure that the final oil product (base stock or base oil) has the desired product pour point);

g) "hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

h) "hydrodewaxing": (e.g., ISODEWAXING® of Chevron or MSDW™ of Exxon Mobil corporation) a very selective catalytic process which in a single step or by use of a single catalyst or catalyst mixture effects conversion of wax by isomerization/rearrangement of the n-paraffins and slightly branched isoparaffins into more heavily branched isoparaffins, the resulting product not requiring a separate conventional catalytic or solvent dewaxing step to meet the desired product pour point;

i) the terms "hydroisomerate", "isomerate", "catalytic dewaxate", and "hydrodewaxate" refer to the products produced by the respective processes, unless otherwise specifically indicated.

Thus the term "hydroisomerization/cat dewaxing" is used to refer to catalytic processes which have the combined effect of converting normal paraffins and/or waxy hydrocarbons by rearrangement/isomerization, into more branched iso-paraffins, followed by (1) catalytic dewaxing to reduce the amount of any residual n-paraffins or slightly branched iso-paraffins present in the isomerate by cracking/fragmentation or by (2) hydrodewaxing to effect further isomerization and very selective catalytic dewaxing of the isomerate, to reduce the product pour point. When the term (or solvent), is included in the recitation, the process described involves hydroisomerization followed by solvent dewaxing which effects the physical separation of wax from the hydroisomerate so as to reduce the product pour point.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) and/or base oil(s) include oils boiling in the lube oil boiling range separated/fractionated from synthesized GTL materials such as for example, by distillation and subsequently subjected to a final wax processing step which is either the well-known catalytic dewaxing process, or solvent dewaxing process, to produce lube oils of reduced/low pour point; synthesized wax isomerates, comprising, for example, hydrodewaxed, or hydroisomerized/cat (or solvent) dewaxed synthesized hydrocarbons; hydrodewaxed, or hydroisomerized/cat (or solvent) dewaxed Fischer-Tropsch (F-T) material (i.e., hydrocarbons, waxy hydrocarbons, waxes and possible analogous oxygenates); preferably hydrode-waxed, or hydroisomerized/cat (or solvent) dewaxed F-T hydrocarbons, or hydrodewaxed or hydroisomerized/cat (or solvent) dewaxed, F-T waxes, hydro-dewaxed, or hydroisomerized/cat (or solvent) dewaxed synthesized waxes, or mixtures thereof.

GTL base stock(s) and/or base oil(s) derived from GTL materials, especially, hydrodewaxed, or hydroisomerized/cat (or solvent) dewaxed F-T material derived base stock(s) and/or base oil(s), and other hydrodewaxed, or hydroisomerized/cat (or solvent) dewaxed wax derived base stock(s) and/or base oil(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 $mm^2/s$ at 100° C. and a viscosity index of about 130. Preferably the wax treatment process is hydrodewaxing carried out in a process using a single hydrodewaxing catalyst. Reference herein to Kinematic viscosity refers to a measurement made by ASTM method D445.

GTL base stocks and/or base oils derived from GTL materials, especially hydrodewaxed, or hydroisomerized/cat (or solvent) dewaxed F-T material derived base stock(s) and/or base oil(s), and other hydrodewaxed, or hydroisomerized/cat (or solvent) dewaxed wax-derived base stock(s) and/or base oil(s), which can be used as base stock and/or base oil components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. In the present invention, however, the GTL or other hydrodewaxed, or hydroisomerized/cat (or solvent) dewaxed wax-derived base stock(s) and/or base oils used are those having pour points of about −30° C. or higher, preferably about −25° C. or higher, more preferably about −20° C. or higher. References herein to pour point refer to measurement made by ASTM D97 and similar automated versions.

The GTL base stock(s) and/or base oil(s) derived from GTL materials, especially hydrodewaxed or hydroisomerized/cat (or solvent) dewaxed F-T material derived base stock(s) and/or base oils, and other such wax-derived base stock(s) and/or base oils which are base stock components which can be used in this invention are also characterized typically as having viscosity indices of 80 or greater, preferably 100 or greater, and more preferably 120 or greater. Additionally, in certain particular instances, the viscosity index of these base stocks and/or base oils may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and/or base oils typically have very low sulfur and nitrogen content, generally containing less than about 10 ppm, and more typically less than about 5 ppm of each of these elements. The sulfur and nitrogen content of GTL base stock and/or base oil obtained by the hydroisomerization/isodewaxing of F-T material, especially F-T wax is essentially nil.

In a preferred embodiment, the GTL base stock(s) and/or base oil(s) comprises paraffinic materials that consist predominantly of non-cyclic isoparaffins and only minor amounts of cycloparaffins. These GTL base stock(s) and/or base oil(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s) and/or base oil(s), hydro-dewaxed or hydroisomerized/cat (or solvent) dewaxed F-T material derived base stock(s), and wax-derived hydrodewaxed, or hydroisomerized/cat (or solvent) dewaxed base stock(s), such as wax isomerates or hydrodewaxates, are recited in U.S. Pat. Nos. 6,080,301; 6,090,989, and 6,165,949 for example.

Such base stock(s) and/or base oil(s), derived from waxy feeds, which are also suitable for use in this invention, are paraffinic fluids of lubricating viscosity derived from hydrodewaxed, or hydroisomerized/cat (or solvent) dewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stocks and/or base oils.

Slack wax is the wax recovered from any waxy hydrocarbon oil including synthetic oil such as F-T waxy oil or petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane.

Slack wax(es) secured from synthetic waxy oils such as F-T waxy oil will usually have zero or nil sulfur and/or nitrogen containing compound content. Slack wax(es) secured from petroleum oils, may contain sulfur and nitrogen containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The term GTL base stock and/or base oil and/or wax isomerate base stock and/or base oil as used herein and in the claims is to be understood as embracing individual fractions of GTL base stock and/or base oil and/or of wax-derived hydrodewaxed or hydroisomerized/cat (or solvent) dewaxed base stock and/or base oil as recovered in the production process, mixtures of two or more GTL base stock(s) and/or base oil(s) fraction(s) and/or wax-derived hydro-dewaxed, or hydroisomerized/cat (or solvent) dewaxed base stock(s) and/or base oil(s) fraction(s), as well as mixtures of one or two or more low viscosity GTL base stock(s) and/or base oil(s) fraction(s) and/or wax-derived hydrodewaxed, or hydroisomerized/cat (or solvent) dewaxed base stock(s) and/or base oil(s) fraction(s) with one, two or more higher viscosity GTL base stock(s) and/or base oil(s) fraction(s) and/or wax-derived hydrodewaxed, or hydroisomerized/cat (or solvent) dewaxed base stock(s) and/or base oil(s) fraction(s) to produce a dumbbell blend wherein the blend exhibits a kinematic viscosity within the aforesaid recited range.

In a preferred embodiment, the GTL material, from which the GTL base stock(s) and/or base oil(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high Schultz-Flory kinetic alpha for producing the more desirable higher molecular weight paraffins. This process is also well known to those skilled in the art.

In an F-T synthesis process, a synthesis gas comprising a mixture of $H_2$ and CO is catalytically converted into hydrocarbons and preferably liquid hydro-carbons. The mole ratio of the hydrogen to the carbon monoxide may broadly range from about 0.5 to 4, but is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for a F-T synthesis reaction is 2.0, but there are many reasons for using other than a stoichiometric ratio as those skilled in the art know. In cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. The term "$C_{5+}$" is used herein to refer to hydrocarbons with a carbon number of greater than 4, but does not imply that material with carbon number 5 has to be present. Similarly other ranges quoted for carbon number do not imply that hydrocarbons having the limit values of the carbon number range have to be present, or that every carbon number in the quoted range is present. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise Titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which the base stock(s) and/or base oil(s) is/are derived is a wax or waxy feed from mineral oil, non-mineral oil, non-petroleum, or other natural source, especially slack wax, or GTL material, preferably F-T material, referred to as F-T wax. F-T wax preferably has an initial boiling point in the range of from 650-750° F. and preferably continuously boils up to an end point of at least 1050° F. A narrower cut waxy feed may also be used during the hydroisomerization. A portion of the n-paraffin waxy feed is converted to lower boiling isoparaffinic material. Hence, there must be sufficient heavy n-paraffin material to yield an isoparaffin containing isomerate boiling in the lube oil range. If catalytic dewaxing is also practiced after isomerization/isodewaxing, some of the isomerate/isodewaxate will also be hydrocracked to lower boiling material during the conventional catalytic dewaxing. Hence, it is preferred that the end boiling point of the waxy feed be above 1050° F. (1050° F.+).

When a boiling range is quoted herein it defines the lower and/or upper distillation temperature used to separate the fraction. Unless specifically stated (for example, by specifying that the fraction boils continuously or constitutes the entire range) the specification of a boiling range does not require any material at the specified limit has to be present, rather it excludes material boiling outside that range.

The waxy feed preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F.⁻ fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, e.g., slack wax or F-T wax, may be characterized as a hydrodewaxing or isomerization process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization or hydrodewaxing catalyst used in subsequent steps. If F-T waxes are used, such preliminary treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from prehydrotreatment for the removal of oxygenates while others may benefit from oxygenates treatment. The hydroisomerization or hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Following any needed hydrodenitrogenation or hydrodesulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking, hydro-dewaxing, or hydroisomerizing GTL materials and/or waxy materials to base stock and/or base oil are described, for example, in U.S. Pat. Nos. 2,817,693; 4,900,407; 4,937,399; 4,975,177; 4,921,594; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099; 6,025,305; 6,080,301; 6,096,940; 6,620,312; 6,676,827; 6,383,366; 6,475,960; 5,059,299; 5,977,425; 5,935,416; 4,923,588; 5,158,671; and 4,897,178; EP 0324528 (B1), EP 0532116 (B1), EP 0532118 (B1), EP 0537815 (B1), EP 0583836 (B2), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359; WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974; and 6,375,830.

Hydrocarbon conversion catalysts useful in the conversion of the n-paraffin waxy feedstocks disclosed herein to form the isoparaffinic hydro-carbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over the hydrodewaxing catalyst comprising Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269. The use of the Group VIII metal loaded ZSM-48 family of catalysts, preferably platinum on ZSM-48, in the hydroisomerization of the waxy feedstock eliminates the need for any subsequent, separate dewaxing step, and is preferred.

A dewaxing step, when needed, may be accomplished using one or more of solvent dewaxing, catalytic dewaxing or hydrodewaxing processes and either the entire hydroisomerate or the 650-750° F.+ fraction may be dewaxed, depending on the intended use of the 650-750° F.− material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Autorefrigerative dewaxing using low molecular weight hydrocarbons, such as propane, can also be used in which the hydroisomerate is mixed with, e.g., liquid propane, a least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention. Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydro-isomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stock(s) and/or base oil(s), hydrodewaxed, or hydroisomerized/cat (or solvent) dewaxed wax-derived base stock(s) and/or base oil(s), have a beneficial kinematic viscosity advantage over conventional API Group II and Group III base stocks, and so may be very advantageously used with the instant invention. Such GTL base stocks and/or base oils can have significantly higher kinematic viscosities, up to about 20-50 $mm^2/s$ at 100° C., whereas by comparison commercial Group II base oils can have kinematic viscosities, up to about 15 $mm^2/s$ at 100° C., and commercial Group III base oils can have kinematic viscosities, up to about 10 $mm^2/s$ at 100° C. The higher kinematic viscosity range of GTL base stocks and/or base oils, compared to the more limited kinematic viscosity range of Group II and Group III base stocks and base oils, in combination with the instant invention can provide additional beneficial advantages in formulating lubricant compositions.

In the present invention mixtures of hydrodewaxate, or hydroisomerate/cat (or solvent) dewaxate base stock(s) and/or base oil(s), mixtures of the GTL base stock(s) and/or base oil(s), or mixtures thereof, preferably mixtures of GTL base stock(s) and/or base oil(s), can constitute all or part of the base oil.

The preferred base stock(s) and/or base oil(s) derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_2 \geqq 4)>15$; and (b) $BI+0.85\ (CH_2 \geqq 4)<45$ as measured over said liquid hydrocarbon composition as a whole.

The preferred GTL base stock and/or base oil can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred BI≧25.4 and ($CH_2$≧4)≦22.5. They have a nominal boiling point of 370° C.+, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV at 100° C.)−7000.

The preferred GTL base stock and/or base oil is also characterized as comprising a mixture of branched paraffins characterized in that the GTL lubricant base stock and/or base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2$≧4), and Free Carbon Index (FCI) are determined as follows:

Branching Index

A 359.88 MHz 1H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the α-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2$≧4)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at 29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a) calculate the average carbon number of the molecules in the sample which is accomplished with sufficient accuracy for lubricating oil materials by simply dividing the molecular weight of the sample oil by 14 (the formula weight of $CH_2$);

b) divide the total carbon-13 integral area (chart divisions or area counts) by the average carbon number from step a. to obtain the integral area per carbon in the sample;

c) measure the area between 29.9 ppm and 29.6 ppm in the sample; and d) divide by the integral area per carbon from step b. to obtain FCI.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH and the methyls are clearly identified by chemical shift and phase. The branching properties of each sample are determined by C-13 NMR using the assumption in the calculations that the entire sample is isoparaffinic. Corrections are not made for n-paraffins or cyclo-paraffins, which may be present in the oil samples in varying amounts. The cycloparaffins content is measured using Field Ionization Mass Spectroscopy (FIMS).

GTL base stock(s) and/or base oil(s), and hydrodewaxed, or hydroisomerized/cat (or solvent) dewaxed wax base stock(s) and/or base oil(s), for example, hydroisomerized or hydrodewaxed waxy synthesized hydrocarbon, e.g., Fischer-Tropsch waxy hydrocarbon base stock(s) and/or base oil(s) are of low or zero sulfur and phosphorus content. There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base oils which themselves, inherently, are of low or zero initial sulfur and phosphorus content. Such oils when used as base oils can be formulated with additives. Even if the additive or additives included in the formulation contain sulfur and/or phosphorus the resulting formulated lubricating oils will be lower or low SAPS oils as compared to lubricating oils formulated using conventional mineral oil base stocks.

Low SAPS formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

The hydrodewaxate and/or hydroisomerate base stock(s) and/or base oil(s), GTL base stock(s) and/or base oil(s), or mixture thereof, preferably GTL base stock(s) and/or base oil(s), can constitute from 5 to 100%, preferably 40 to 100%, more preferably 70 to 100% by weight of the total of the hydrodewaxate and/or hydroisomerate base stock(s) and/or base oil(s), GTL base stock(s) and/or base oil(s) or mixture thereof, preferably GTL base stock(s) and/or base oil(s) the amount employed being left to the practitioner in response to the requirements of the finished lubricant.

The Group I high viscosity mineral oil stock(s) consist(s) of high-viscosity hydrocarbyl lubricant oil(s) that is/are highly refined and dewaxed, derived from mineral source, with <90% saturates, and with kinematic viscosity at 100° C. (according to ASTM D445) typically ranging about 12 $mm^2/s$ and higher, preferably about 18 $mm^2/s$ and higher, more preferably about 24 $mm^2/s$ and higher, and even more preferably about 28 $mm^2/s$ and higher. They typically have high end viscosities of about 120 $mm^2/s$, preferably about 60 $mm^2/s$, more preferably about 40 $mm^2/s$ @100° C. Such lubricant oil(s) typically has/have a density at 60° F. (according to ASTM D4052) in the range from about 0.885 to 0.920 $g/cm^3$, preferably from about 0.890 to 0.915 $g/cm^3$, and more preferably from about 0.895 to 0.910 $g/cm^3$. This/These lubricant oils typically has/have a viscosity index in the range of about 90 to 100. This/These lubricant oil(s) also has/have a useful pour point (according to ASTM D97) of about 0° C. or lower, preferably about −3° C. or lower, and more preferably about −6° C. or lower. Preferably the oil is Bright Stock.

Because of their higher viscosity, such high viscosity Group I mineral oil(s), and especially Bright Stock, is/are particularly useful in combination with lower viscosity base stocks/base oils because the blended oil can achieve higher useful viscosities. Such blended lubricant composition viscosities can be particularly useful in lubricating mechanical systems that operate at high temperatures. So the current invention offers the unique advantage of both improving lubricant composition solvency and achieving higher useful lubricant composition viscosity.

The combination of one or more hydrodewaxate and/or hydroisomerate base stock(s) and/or base oil(s), GTL base stock(s) and/or base oil(s) or mixture thereof, preferable GTL base stock(s) and/or base oils with the high viscosity Group I mineral oil permits the production of base oils having kinematic viscosities at 100° C. of 6 $mm^2/s$ or higher, preferably 7 $mm^2/s$ or higher, more preferably 8 $mm^2/s$ or higher, most preferably 9 $mm^2/s$ or higher, and with good/improved solvency.

The high viscosity Group I mineral oil is added to the one or more hydrodewaxate and/or hydroisomerate base stock(s) and/or base oils, GTL base stock(s) and/or base oil or mixture thereof preferably GTL base stock(s) and/or base oil(s) in amounts ranging from about 1 to 55 wt %, preferably about 5 to 55 wt % high viscosity Group I mineral oil, more preferably about 10 to 55 wt % high viscosity Group I mineral oil, even more preferably about 20 to 55 wt % high viscosity Group I mineral oil, based on the total weight of the mixture of base stock comprising one or more hydrodewaxate and/or hydroisomerate base stock(s) and/or base oil, GTL base stock(s) and/or base oil or mixture thereof, preferably GTL base stock(s) and the high viscosity Group I mineral oil.

The base stock and/or base oil mixtures defined above may be blended with conventional base stock such as Group I, Group II, Group III, Group IV and/or Group V stocks as defined by the American Petroleum Institute, the present mixtures constituting the majority of any such combination, i.e., more than 50 wt %, preferably more than 60 wt %, more preferably more than 75 wt % of any such base oil combination. Further, the mixture of one or more hydro-dewaxate and/or hydroisomerate base stock(s) and/or base oil(s), GTL base stock(s) and/or base oil(s), or mixture thereof, preferably GTL base stock(s) and/or base oil(s), and high viscosity Group I base oil may be blended with effective amounts of one or more suitable additives to form lubricant compositions.

Examples of typical additives include, but are not limited to, oxidation inhibitors, antioxidants, dispersants, detergents, corrosion inhibitors, rust inhibitors, metal deactivators, antiwear agents, extreme pressure additives, anti-seizure agents, pour point depressants, wax modifiers, viscosity index improvers, viscosity modifiers, viscosity index improvers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

Finished lubricants comprise the lubricant base stock or base oil, plus at least one performance additive.

The types and quantities of performance additives used in combination with the instant invention in lubricant compositions are not limited by the examples shown herein as illustrations.

Antiwear and EP Additives

Many lubricating oils require the presence of antiwear and/or extreme pressure (EP) additives in order to provide adequate antiwear protection. Increasingly specifications for, e.g., engine oil performance have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithio-phosphate in which the primary metal constituent is zinc, or zinc dialkyldithio-phosphate (ZDDP). ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

However, it is found that the phosphorus from these additives has a deleterious effect on the catalyst in catalytic converters and also on oxygen sensors in automobiles. One way to minimize this effect is to replace some or all of the ZDDP with phosphorus-free antiwear additives.

A variety of non-phosphorous additives are also used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984, incorporated by reference herein in its entirety.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithio-carbamate trimer complex ($R{=}C_8$-$C_{18}$ alkyl) are also useful antiwear agents. The use or addition of such materials should be kept to a minimum if the object is to produce low SAP formulations.

Esters of glycerol may be used as antiwear agents. For example, mono-, di- and tri-oleates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics, for example dimercaptothia-diazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

Viscosity Index Improvers

Viscosity index improvers (also known as VI improvers, viscosity modifiers, and viscosity improvers) provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity index improvers are polymers and copolymers of methacrylate, butadiene, olefins, or alkylated styrenes. Poly-isobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Viscosity index improvers may be used in an amount of about 0.01 to 8 wt %, preferably about 0.01 to 4 wt %.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example, each of which is incorporated by reference herein in its entirety.

Useful antioxidants include hindered phenols. These phenolic anti-oxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols, arylamines. These antioxidants may be used individually by type or in combination with one another. Such additives may be used in an amount of about 0.01 to 5 wt %, preferably about 0.01 to 1.5 wt %, more preferably zero to less than 1.5 wt %, most preferably zero.

Detergents

Detergents are commonly used in lubricating compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydro-carbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in Lubricants and Related Products, op cit discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

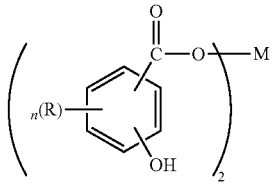

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction. See U.S. Pat. No. 3,595,791, which is incorporated herein by reference in its entirety, for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium salicylates and other related components (including borated detergents). Typically, the total detergent concentration is about 0.01 to about 6.0 wt %, preferably, about 0.1 to 0.4 wt %.

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose. Each of the aforementioned patents is incorporated herein in its entirety by reference.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044, which are incorporated herein in their entirety by reference.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305, incorporated herein by reference.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039, which are incorporated herein in their entirety by reference.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, penta-ethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, penta-propylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197, which are incorporated herein in their entirety by reference.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %.

Pour Point Depressants

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include poly-methacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2.721,878; and 3,250,715 describe useful pour point depressants and/or the preparation thereof. Each of these references is incorporated herein in its entirety. Such additives may be used in an amount of about 0.01 to 5 wt %, preferably about 0.01 to 1.5 wt %.

Corrosion Inhibitors

Corrosion inhibitors are used to reduce the degradation of metallic parts that are in contact with the lubricating oil composition. Suitable corrosion inhibitors include thiadiazoles. See, for example, U.S. Pat. Nos. 2,719,125; 2,719,126; and 3,087,932, which are incorporated herein by reference in their entirety. Such additives may be used in an amount of about 0.01 to 5 wt %, preferably about 0.01 to 1.5 wt %.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.1 percent.

Inhibitors and Antirust Additives

Antirust additives (or corrosion inhibitors) are additives that protect lubricated metal surfaces against chemical attack by water or other contaminants. A wide variety of these are commercially available; they are referred to in Klamann in Lubricants and Related Products, op cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt %.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. No. 5,824,627; U.S. Pat. No. 6,232,276; U.S. Pat. No. 6,153,564; U.S. Pat. No. 6,143,701; U.S. Pat. No. 6,110,878; U.S. Pat. No. 5,837,657; U.S. Pat. No. 6,010,987; U.S. Pat. No. 5,906,968; U.S. Pat. No. 6,734,150; U.S. Pat. No. 6,730,638; U.S. Pat. No. 6,689,725; U.S. Pat. No. 6,569,820; WO 99/66013; WO 99/47629; WO 98/26030.

Ashless friction modifiers may have also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10-15 wt % or more, often with a preferred range of about 0.1 wt % to 5 wt %. Concentrations of molybdenum-containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures with the materials of this invention. Often mixtures of two or more friction modifiers, or mixtures of friction modifier(s) with alternate surface active material(s), are also desirable.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 1 below.

Note that many of the additives are shipped from the manufacturer and used with a certain amount of base oil solvent in the formulation. Accordingly, the weight amounts in the table below, as well as other amounts mentioned in this patent, are directed to the amount of active ingredient (that is the non-solvent portion of the ingredient). The wt % indicated below are based on the total weight of the lubricating oil composition.

TABLE 1

Typical Amounts of Various Lubricant Oil Components

| Compound | Approximate Wt % (Useful) | Approximate Wt % (Preferred) |
|---|---|---|
| Detergent | 0.01-6 | 0.01-4 |
| Dispersant | 0.1-20 | 0.1-8 |

TABLE 1-continued

Typical Amounts of Various Lubricant Oil Components

| Compound | Approximate Wt % (Useful) | Approximate Wt % (Preferred) |
|---|---|---|
| Friction Reducer | 0.01-5 | 0.01-1.5 |
| Viscosity Index Improver | 0.0-40 | 0.01-30, more preferably 0.01-15 |
| Supplementary Antioxidant | 0.0-5 | 0.0-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base Oil | Balance | Balance |

EXAMPLES

F-T wax isomerate GTL-type base oil, specifically GTL4 having 4 $mm^2/s$ kinematic viscosity at 100° C., was compared to PAO, specifically PAO4 having 4 $mm^2/s$ kinematic viscosity at 100° C., in combination with mineral derived base oils, specifically Group I type mineral oils having kinematic viscosities in the range of 4-32 $mm^2/s$ at 100° C. Base oil properties are listed in Table 2.

Combinations of wax isomerate base oil, specifically GTL4, with mineral oils (shown in Table 3) were compared to combinations of PAO, specifically PAO4, with mineral oils (shown in Table 4). Binary combination of GTL4/Bright Stock (50:50 by wt %) was compared to binary combination of PAO4/Bright Stock (50:50 by wt %) by measurement of their respective aniline points as were binary combinations of GTL/SPN 100, GTL/SPN 600, PAO/SPN 100 and PAO/SPN 600. Further binary mixtures of SPN 100/SPN 600 and SPN 100/Bright Stock were also compared. Comparison of the pure base oils and of the 50:50 wt % combinations is shown in Tables 3 and 4 and in FIG. 1. The aniline point of the GTL4/Bright Stock (50:50 by wt %) has lower aniline point (1.7° C. lower aniline point) than what would be the expected aniline point profile for GTL4/Bright Stock mixtures. Even more surprisingly, the aniline point of the GTL4/Bright Stock (50:50 by weight) was lower (0.5° C. lower aniline point) than that measured for PAO4/Bright Stock (50:50 by weight). This novel and unexpected result demonstrates that GTL in combination with Bright Stock is significantly improved over that of PAO in combination with the same Bright Stock in terms of solvency.

Further, the greatest unexpected advantage of this invention is illustrated in FIG. 1, where the wax isomerate (GTL4)/Bright Stock combination containing up to about 55% Bright Stock concentration has an aniline point lower than that of either the wax isomerate (GTL4) or bright stock alone.

TABLE 2

Base Oil Properties

| Base Oils | KV @ 100° C. ($mm^2/s$) | KV @ 40° C. ($mm^2/s$) | Aniline Point (° C.) | Viscosity Index | Density ($g/cm^3$) | Pour Point (° C.) |
|---|---|---|---|---|---|---|
| GTL4 | 3.8 | 15.3 | 120.4 | 143 | 0.8133 | ≦−12 |
| PAO4 | 4.0 | 17.9 | 120.2 | 124 | 0.8192 | −54 |
| SPN 100 (Min. Oil) | 4.0 | 20.2 | 96.3 | 95 | 0.8649 | −15 |
| SPN 600 (Min. Oil) | 12.2 | 115.3 | 113.4 | 96 | 0.8841 | −12 |
| Bright Stock (Min. Oil) | 31.8 | 487.8 | 123.1 | 96 | 0.9017 | ≦−6 |

TABLE 3

Wax Isomerate-Mineral Oil Combinations; Aniline Point Performance

| Example | Lubricant Base Oil Compositions (wt %) GTL 4 | SPN 100 | SPN 600 | Bright Stock | Measured Aniline Point (° C.), D611 | Predicted Aniline Point by Linear Combination (° C.) | Change in Measured Aniline Point vs. Prdicated (° C.) | KV @ 100° C. ($mm^2/s$) |
|---|---|---|---|---|---|---|---|---|
| | 100 | | | | 120.4 | | | |
| | | 100 | | | 96.3 | | | |
| | | | 100 | | 113.4 | | | |
| | | | | 100 | 123.1 | | | |
| A | 50 | 50 | | | 108.6 | 108.4 | +0.2 | 3.9 |
| B | 50 | | 50 | | 116.4 | 116.9 | −0.5 | 6.3 |
| C | 50 | | | 50 | 120.1 | 121.8 | −1.7 | 9.0 |
| D | 33.4 | | 33.3 | 33.3 | 118.0 | 119.0 | −1.0 | 9.8 |
| E | | 50 | 50 | | 105.2 | 104.8 | +0.4 | 6.9 |
| F | | 50 | | 50 | 110.4 | 109.7 | +0.7 | 10.4 |

TABLE 4

PAO-Mineral Oil Combinations; Aniline Point Performance

| Example | Lubricant Base Oil Compositions (wt %) PAO 4 | SPN 100 | SPN 600 | Bright Stock | Measured Aniline Point (° C.), D611 | Predicted Aniline Point by Linear Combination (° C.) | Change in Measured Aniline Point vs. Predicted (° C.) |
|---|---|---|---|---|---|---|---|
| | 100 | | | | 120.2 | | |
| | | 100 | | | 96.3 | | |
| | | | 100 | | 113.4 | | |
| | | | | 100 | 123.1 | | |
| G | 50 | 50 | | | 108.8 | 108.2 | +0.6 |
| H | 50 | | 50 | | 116.0 | 116.8 | −0.8 |
| I | 50 | | | 50 | 120.6 | 121.6 | −1.0 |
| J | 33.4 | | 33.3 | 33.3 | 118.2 | 118.9 | −0.7 |
| D | | 50 | 50 | | 105.2 | 104.8 | +0.4 |
| E | | 50 | | 50 | 110.4 | 109.7 | +0.7 |

What is claimed is:

1. A method for improving the solvency of base oil(s) comprising one or more hydrodewaxate base stock(s) and base oil(s), hydroisomerate base stock(s) and base oil(s), GTL base stock(s) and base oil(s), and mixtures thereof and improving the capacity of said base oils to solubilize performance additives, said base oil(s) having a kinematic viscosity at 100° C. of 3 $mm^2/s$ to about 50 $mm^2/s$ by addition to the base oil of a high viscosity Group I mineral oil, the high viscosity Group I mineral oil being characterized as having a kinematic viscosity at 100° C. of about 12 $mm^2/s$ and higher, the high viscosity Group I mineral oil being added to the base oil in an amount ranging from about 1 to about 55 wt % high viscosity Group I mineral oil based on the total weight of the mixture of the one or more hydrodewaxate base stock(s), hydroisomerate base stock(s), GTL base stock(s) or mixture thereof and the high viscosity Group I mineral oil whereby the solvency of the mixture is improved as evidenced by the mixture having an aniline point below the aniline point of the hydrodewaxate base stock(s) and/or base oil(s), hydroisomerate base stock(s) and/or base oil(s), GTL base stock(s) and/or base oil(s) or mixtures thereof and below the linear average of the aniline points of the high viscosity Group I mineral oil, and the hydrodewaxate base stock(s) and base oil(s), hydroisomerate base stock(s) and base oil(s), GTL base stock(s) and base oil(s) and mixtures thereof.

2. The method of claim 1 wherein the high viscosity Group I mineral oil has a kinematic viscosity at 100° C. of about 18 $mm^2/s$ and higher.

3. The method of claim 1 wherein the high viscosity Group I mineral oil has a kinematic viscosity at 100° C. of about 24 $mm^2/s$ and higher.

4. The method of claim 1 wherein the high viscosity Group I mineral oil has a kinematic viscosity at 100° C. of about 28 $mm^2/s$ and higher.

5. The method of claim 1, 2, 3 or 4 wherein the high viscosity Group I mineral oil has a density at 60° F. in the range of about 0.8885 to 0.920 $g/cm^3$ and a VI in the range of about 90 to 100.

6. The method of claim 1, 2, 3 or 4 wherein the high viscosity Group I mineral oil is added to the base oil comprising one or more hydrodewaxate base stock(s) and base oil(s), hydroisomerate base stock(s) and base oil(s), GTL base stock(s) and base oil(s), or mixtures thereof in an amount in the range of about 5 to 55 wt % high viscosity Group I mineral oil based on the total weight of the mixture.

7. The method of claim 1, 2, 3 or 4 wherein the high viscosity Group I mineral oil is added to the base oil comprising one or more hydrodewaxate base stock(s) and base oil(s), hydroisomerate base stock(s) and base oil(s), GTL base stock(s) and base oil(s), or mixture thereof in an amount in the range of about 10 to 55 wt % high viscosity Group I mineral oil based on the total weight of the mixture.

8. The method of claim 5 wherein the high viscosity Group I mineral oil is added to the base oil comprising one or more hydrodewaxate base stock(s) and base oil(s), hydroisomerate base stock(s) and base oil(s), GTL base stock(s) and base oil(s), or mixtures thereof in an amount in the range of about 5 to 55 wt % high viscosity Group I mineral oil based on the total weight of the mixture.

9. The method of claim 5 wherein the high viscosity Group I mineral oil is added to the base oil comprising one or more hydrodewaxate base stock(s) and/or base oil(s), hydroisomerate base stock(s) and/or base oil(s), GTL base stock(s) and/or base oil(s), or mixtures thereof in an amount in the range of about 10 to 55 wt % high viscosity Group I mineral oil based on the total weight of the mixture.

10. The method of claim 1, 2, 3 or 4 wherein the base oil has a kinematic viscosity at 100° C. of about 3.5 $mm^2/s$ to about 30 $mm^2/s$.

11. The method of claim 5 wherein the base oil has a kinematic viscosity at 100° C. of about 3.5 $mm^2/s$ to about 30 $mm^2/s$.

12. The method of claim 8 wherein the base oil has a kinematic viscosity at 100° C. of about 3.5 $mm^2/s$ to about 30 $mm^2/s$.

13. The method of claim 1, 2, 3 or 4 wherein the base oil is a GTL material hydrodewaxate or hydroisomerate.

14. The method of claim 1, 2, 3 or 4 wherein the base oil is a Fischer-Tropsch material hydrodewaxate or hydroisomerate.

15. A lubricating oil stock of improved solvency comprising a mixture of a base oil comprising one or more hydrodewaxate base stock(s) and/or base oil(s), one or more hydroisomerate base stock(s) and/or base oil(s), GTL base stock(s) and/or base oil(s), or mixtures thereof and 1 to 55 wt % of a high viscosity Group I mineral oil, said Group I mineral oil being characterized as having a kinematic viscosity at 100° C. of about 12 $mm^2/s$ and higher whereby the solvency of the mixture is improved as evidenced by the mixture having an aniline point below the aniline point of the hydrodewaxate base stock(s) and/or base oil(s), hydroisomerate base stock(s) and/or base oil(s), GTL base stock(s) and/or base oil(s) or mixtures thereof and below the linear average of the aniline points of the high viscosity Group I mineral oil than the hydrodewaxate base stock(s) and/or base oil(s), hydroisomerate base stock(s) and/or base oil(s), GTL base stock and/or base oil and mixtures thereof.

16. The lubricating oil stock of claim 15 wherein the base oil has a kinematic viscosity at 100° C. of about 3.5 $mm^2/s$ to about 30 $mm^2/s$.

17. The lubricating oil stock of claim 15 wherein the base oil is a GTL material hydrodewaxate or hydroisomerate.

18. The lubricating oil stock of claim 15 wherein the base oil is a Fischer-Tropsch material hydrodewaxate or hydroisomerate.

19. The lubricating oil stock of claim 15, 16, 17 or 18 wherein the high viscosity Group I mineral oil has a kinematic viscosity at 100° C. of about 18 $mm^2/s$ and higher.

20. The lubricating oil stock of claim 19 wherein the high viscosity Group I mineral oil has a kinematic viscosity at 100° C. of about 24 $mm^2/s$ and higher.

21. The lubricating oil stock of claim 20 wherein the high viscosity Group I mineral oil has a kinematic viscosity at 100° C. of about 28 $mm^2/s$ and higher.

22. The lubricating oil stock of claim 15, 16, 17 or 18 wherein the high viscosity Group I mineral oil has a density at 60° F. in the range of about 0.885 to 0.920 $g/cm^3$ and a VI in the range of about 90 to 100.

23. A lubricating oil formulation comprising a base oil/base stock mixture comprising one or more base oils selected from hydrodewaxate base stock(s) and/or base oil(s), hydroisomerate base stock(s) and/or base oil(s), GTL base stock(s) and/or base oil(s), or mixture thereof having a kinematic viscosity at 100° C. of 3 $mm^2/s$ to 50 $mm^2/s$, and a high viscosity Group I mineral oil stock having a kinematic viscosity at 100° C. of about 12 $mm^2/s$ and higher present in an amount in the range of 1 to 55 wt % based on the total weight of the one or more hydrodewaxate base stock(s) and/or base oil(s), hydroisomerate base stock(s) and/or base oil(s), GTL base stock(s) and/or base oil(s), or mixture thereof and the high viscosity Group I mineral oil, and an additive amount of at least one performance additive, wherein the base oil/base stock mixture is of improved solvency as evidenced by the mixture having an aniline point below the aniline point of the hydrodewaxate base stock(s) and/or base oil(s), hydroisomerate base stock(s) and/or base oil(s), GTL base stock(s) and/or base oil(s) or mixtures thereof and below the linear average of the aniline points of the hydrodewaxate base stock(s) and/or base oil(s), hydroisomerate base stock(s) and/or base oil(s), GTL base stock(s) and/or base oil(s) or mixtures thereof and high viscosity Group I mineral oil stock.

24. The lubricating oil formulation of claim 23 wherein the base oil has a kinematic viscosity at 100° C. of about 3.5 $mm^2/s$ to about 30 $mm^2/s$.

25. The lubricating oil formulation of claim 23 wherein the base oil is a GTL material hydrodewaxate or hydroisomerate.

26. The lubricating oil formulation of claim 23 wherein the base oil is a Fischer-Tropsch material hydrodewaxate or hydroisomerate.

27. The lubricating oil formulation of claim 23, 24, 25 or 26 wherein the high viscosity Group I mineral oil has a kinematic viscosity at 100° C. of about 18 $mm^2/s$ and higher.

28. The lubricating oil formulation of claim 27 wherein the high viscosity Group I mineral oil has a kinematic viscosity at 100° C. of about 24 $mm^2/s$ and higher.

29. The lubricating oil formulation of claim 28 wherein the high viscosity Group I mineral oil has a kinematic viscosity at 100° C. of about 28 $mm^2/s$ and higher.

30. The lubricating oil formulation of claim 23, 24, 25 or 26 wherein the high viscosity Group I mineral oil has a density at 60° F. in the range of about 0.885 to 0.920 $g/cm^3$ and a VI in the range of about 90 to 100.

31. A lubricating oil additive concentrate comprising at least one performance additive in a dissolving quantity of a lubricating oil stock comprising a base oil mixture comprising one or more of hydrodewaxate base stock(s) and/or base oil(s), hydroisomerate base stock(s) and/or base oil(s), GTL base stock(s) and/or base oil(s), or mixture thereof having a kinematic viscosity at 100° C. of 3 $mm^2/s$ to 50 $mm^2/s$ and a high viscosity Group I mineral oil stock having a kinematic viscosity at 100° C. of about 12 $mm^2/s$ and higher, said high viscosity Group I mineral oil being present in an amount in the range of 1 to 55 wt % based on the total weight of the one or more hydrodewaxate base stock(s) and/or base oil(s), hydroisomerate base stock(s) and/or base oil(s), GTL base stock(s) and/or base oil(s), or mixture thereof and the high viscosity Group I mineral oil, wherein the base oil mixture is of improved solvency as evidenced by the mixture having an aniline point the aniline point of the hydrodewaxate base stock(s) and/or base oil(s), hydroisomerate base stock(s) and/or base oil(s), GTL base stock(s) and/or base oil(s) or mixture thereof and below the linear average of the aniline points of the hydrodewaxate base stock(s) and/or base oil(s) hydroisomerate base stock(s) and/or base oil(s), GTL base stock(s) and/or base oil(s) or mixtures thereof, and the high viscosity Group I mineral oil stock.

32. The lubricating oil additive concentrate of claim 31 wherein the base oil comprising one or more hydrodewaxate base stock(s) and/or base oil(s), hydroisomerate base stocks) and/or base oil(s), GTL base stock(s) and/or base oil(s), or mixture thereof has a kinematic viscosity at 100° C. of about 3.5 $mm^2/s$ to about 30 $mm^2/s$.

33. The lubricating oil additive concentrate of claim 31 wherein the base oil comprising one or more hydrodewaxate base stock(s) and/or base oil(s), hydroisomerate base stock(s) and/or base oil(s), GTL base stock(s) and/or base oil(s), or mixture thereof is a GTL material isomerate.

34. The lubricating oil additive concentrate of claim 33 wherein the base oil is a Fischer-Tropsch material hydrodewaxate or hydroisomerate.

35. The lubricating oil additive concentrate of claim 31, 32, 33 or 34 wherein the high viscosity Group I mineral oil has a kinematic viscosity at 100° C. of about 18 $mm^2/s$ and higher.

36. The lubricating oil additive concentrate of claim 35 wherein the high viscosity Group I mineral oil has a kinematic viscosity at 100° C. of about 24 $mm^2/s$ and higher.

37. The lubricating oil additive concentrate of claim 36 wherein the high viscosity Group I mineral oil has a kinematic viscosity at 100° C. of about 28 $mm^2/s$ and higher.

38. The lubricating oil additive concentrate of claim 37 wherein the high viscosity Group I mineral oil has a density at 60° F. in the range of about 0.885 to 0.920 $g/cm^3$ and a VI in the range of about 90 to 100.

* * * * *